US010238245B2

(12) United States Patent
Rubenson et al.

(10) Patent No.: US 10,238,245 B2
(45) Date of Patent: Mar. 26, 2019

(54) INTERFACE FOR AN AUTOMATIC HYGIENIC SHEET PAPER DISPENSER

(71) Applicant: SCA Hygiene Products AB, Göteborg (SE)

(72) Inventors: Johan Rubenson, Göteborg (SE); Håkan Timdahl, Partille (SE); Björn Henriksson, Göteborg (SE); Robert Kling, Skene (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 15/306,209

(22) PCT Filed: Apr. 25, 2014

(86) PCT No.: PCT/SE2014/050511
§ 371 (c)(1),
(2) Date: Oct. 24, 2016

(87) PCT Pub. No.: WO2015/163802
PCT Pub. Date: Oct. 29, 2015

(65) Prior Publication Data

US 2017/0042390 A1 Feb. 16, 2017

(51) Int. Cl.
*A47K 10/32* (2006.01)
*A47K 10/44* (2006.01)
(Continued)

(52) U.S. Cl.
CPC ..... *A47K 10/32* (2013.01); *A47K 10/44* (2013.01); *A47K 2010/3226* (2013.01);
(Continued)

(58) Field of Classification Search
CPC ..... A47K 10/32; A47K 10/44; A47K 2010/3226; A47K 2010/3233; A47K 2010/3668; A47K 2010/3881
(Continued)

(56) References Cited

U.S. PATENT DOCUMENTS 4,738,176 A * 4/1988 Cassia ..... A47K 10/36 83/208
5,408,417 A * 4/1995 Wilder ..... G06Q 10/02 235/381
(Continued)

FOREIGN PATENT DOCUMENTS

DE 20 2011 105459 U1 1/2012
RU 2441566 C2 2/2012
WO WO-00/63100 A1 10/2000

OTHER PUBLICATIONS

European Search Report dated Dec. 19, 2017 issued in EP application No. 14890074.9.
(Continued)

*Primary Examiner* — Michael Collins
(74) *Attorney, Agent, or Firm* — Drinker Biddle & Reath LLP

(57) ABSTRACT

The disclosure concerns an interface for communicating with and for controlling the operation of an automatic hygienic sheet material dispenser. The interface includes a user sensor to detect the presence of a user within a sensing zone, at least one indicator for indicating the setting of an operational parameter, a main microcontroller, at least one additional sensor for adjusting a dispenser operational parameter or activating a dispenser function, and a protective cover including a graphical symbol or text. The at least one additional sensor, the at least one indicator, and the main microcontroller are located on a main printed circuit board located behind the protective cover and arranged such that
(Continued)

the at least one graphical symbol or text overlaps with the at least one additional sensor or the at least one indicator. The main microcontroller is arranged to selectively operate the dispenser in a user setting or a maintenance setting.

33 Claims, 5 Drawing Sheets

(51) Int. Cl.
*A47K 10/36* (2006.01)
*A47K 10/38* (2006.01)

(52) U.S. Cl.
CPC ..... *A47K 2010/3233* (2013.01); *A47K 2010/3668* (2013.01); *A47K 2010/3881* (2013.01)

(58) Field of Classification Search
USPC ..... 700/231–244
See application file for complete search history.

(56) References Cited

U.S. PATENT DOCUMENTS 6,412,655 B1 * 7/2002 Stuetzel ..... A47K 10/36 221/13
7,044,421 B1 * 5/2006 Omdoll ..... A47K 10/36 242/563
8,833,691 B1 * 9/2014 Zosimadis ..... B65H 16/005 242/563.2
2003/0132288 A1 * 7/2003 Fulcher ..... G06Q 30/0284 235/381
2007/0194166 A1 * 8/2007 Reinsel ..... A47K 10/36 242/563
2008/0190982 A1 * 8/2008 Omdoll ..... A47K 10/3656 225/14
2009/0195385 A1 * 8/2009 Huang ..... G08B 21/245 340/572.1
2010/0114366 A1 * 5/2010 Case ..... A47K 10/36 700/232
2010/0301157 A1 * 12/2010 Keily ..... A47K 10/34 242/564.1
2012/0065775 A1 * 3/2012 Ward ..... G07F 9/02 700/232
2013/0213995 A1 * 8/2013 Horel ..... A47K 10/424 221/197
2014/0316560 A1 * 10/2014 Hoormann ..... G07F 9/023 700/232

OTHER PUBLICATIONS

Russian Office Action dated Jan. 25, 2018, along with its Englishy-language translation.
Decision to Grant dated Jun. 18, 2018 in corresponding Russian patent application No. 2016146107/12(074002), along with its English-language translation attached.

* cited by examiner

INTERFACE FOR AN AUTOMATIC HYGIENIC SHEET PAPER DISPENSER

CROSS-REFERENCE TO PRIOR APPLICATION

This application is a § 371 National Stage Application of PCT International Application No. PCT/SE2014/050511 filed Apr. 25, 2014, which is incorporated herein in its entirety.

TECHNICAL FIELD

The disclosure relates to an interface for communicating with and for controlling the operation of an automatic hygienic sheet material dispenser. The interface includes a user sensor arranged to have a sensing zone and to detect the presence of a user within the sensing zone, at least one indicator for indicating the setting or status of an operational parameter of the dispenser, and a main microcontroller.

BACKGROUND

Automatic hygienic sheet material dispensers were previously known. Such a dispenser has different ways of interfacing with a service person or another person responsible for operating and servicing the dispenser, and for interfacing with regular users wishing to use the dispenser. The dispenser may include sensor means for automatically detecting the presence of a user and dispensing a certain amount of sheet material in such case. The dispenser may also include indicators for indicating a current operating mode or other status indicators for the operation of the dispenser, such as a low battery status and a low remaining supply of sheet material. A dispenser normally also includes a microcontroller configured for controlling the operation of the dispenser based for example on input information from said sensor means. The microcontroller is then configured for initiating and indicating various operating modes.

According to known technology, such sensor means and indicators, and also a microcontroller, can be positioned in various places on the dispenser, such as for example on a front, left and right side of such a dispenser. Also, the settings can be adjusted by various means on the dispenser, such as knobs, levers, dials or similar. As mentioned, these means can be located in various locations on different dispensers, thereby making it difficult for a service person or another person in charge of the dispensers to remember the placement of the means used for changing the settings or the indicators making operation of a dispenser an arduous and time consuming task. The distribution of sensor means, indicators and microcontroller also results in increased cost for signal communication means and manufacturing complexity. Furthermore, the knobs, lever and buttons for adjusting the settings of the interface have limited reliability and may be exposed to a humid environment.

There is thus a need for an improved interface for an automatic sheet dispenser wherein at least one of the above mentioned issues is addressed.

SUMMARY

It is desired to provide an intuitive interface for communicating with and for controlling the operation of an automatic hygienic sheet material dispenser where the previously mentioned problems are at least partly avoided.

An aspect relates to an interface for communicating with and for controlling the operation of an automatic hygienic sheet material dispenser. The interface includes a user sensor arranged to have a sensing zone and to detect the presence of a user within the sensing zone, at least one indicator for indicating the setting or status of an operational parameter of the dispenser, and a main microcontroller.

The interface further includes at least one additional sensor for adjusting at least one dispenser operational parameter or for activating at least one dispenser function, and a protective cover including at least one graphical symbol or text. The at least one additional sensor, the at least one indicator and the main microcontroller are located on a main printed circuit board. The main printed circuit board is located behind the protective cover and arranged relative the at least one graphical symbol or text such that the at least one graphical symbol or text overlaps with the at least one additional sensor or the at least one indicator. The main microcontroller is arranged to selectively operate the dispenser in any of at least a user setting and a maintenance setting.

By locating the at least one additional sensor, the at least one indicator and the main microcontroller jointly on the main printed circuit board, manufacturing of the interface as a single unit and installation of the interface in a dispenser housing in a simple and cost-effective manner is enabled. Also, the above-mentioned components will be located within a limited area on the dispenser, which means that an operator of a dispenser having such an interface does not have to search for where the sensors and the indicator are located. This leads to a more intuitive operation of a dispenser. Furthermore, by placing the main printed circuit board behind a protective cover having at least one graphical symbol or text, and by arranging the circuit board and graphical symbol or text such that the at least one graphical symbol or text overlaps with the at least one additional sensor or the at least one indicator, virtual buttons are provided. The virtual buttons are based on sensor means that are not exposed to any forces or any impact from the outside of the dispenser, while enabling use of reliable and cost-effective non-contact button designs. Also, most sensors and indicators can be completely integrated within the printed circuit board construction, which means that the number of cables can be minimized, thereby enabling simplified manufacturing. The interface operates primarily in a maintenance setting or a user setting, thereby enabling specific and adapted dispenser functionality in each operating setting for improved performance.

In summary, the interface is configured so that a number of control functions and indicators are concentrated in a relatively small area, which simplifies the use of a hygienic sheet material dispenser including the interface. The interface also provides good protection against moisture and dust, high reliability, reduced cost and improved performance.

The term "sheet material", as used herein, relates to a material which is generally in the form of tissue paper, wiping paper or nonwoven material. "Nonwoven material", as used herein, refers to a material based on a mixture of plastic fibres and cellulose-based fibres. The sheet material can be arranged in the form of a perforated or non-perforated roll, or as a stack including a continuous web of folded sheets with or without perforations.

Furthermore, the term "hygienic", as used herein, relates to material which is used to dry hands after hand washing and wipe liquids in bathrooms, washrooms, domestic kitchens, restaurant kitchens and in factories and similar environments. In other words, the hygienic sheet material as referred to in this disclosure is constituted by a material which is used where there are requirements to obtain clean and dry surfaces, i.e. to wipe and clean various surfaces, to take up liquid and solid spoils, and optionally to use together with dedicated liquids for cleaning, treating, disinfecting and similar purposes.

In the context of this disclosure, the term "user setting" refers to an operating setting in which the dispenser operates and dispenses sheet material to users automatically. Normally during user setting, the dispenser is in a closed state and without access to the sheet material from outside the dispenser. The user setting may include at least two different operating modes, namely sensor mode and hanging mode.

In the context of this disclosure, the term "sensor mode" refers to an operating mode of the dispenser in which at least one sensor is arranged to scan for the presence of a user. If the sensor detects that a user is present, the dispenser will be actuated so as to feed a certain length of a hygienic sheet material.

In the context of this disclosure, the term "hanging mode" refers to an operating mode in which a certain length of hygienic sheet material is hanging out of the dispenser in a stand-by state waiting for a user to tear off said length. When said length of sheet material is torn off, a new length is fed out of the dispenser, i.e. the "hanging mode" is maintained.

In the context of this disclosure, the term "maintenance setting" refers to an operating setting of the dispenser which is automatically or manually selected in connection with servicing the dispenser by a service person. For enabling refill of sheet material, adjustment of settings and the like, certain dispenser functions can be inactivated during maintenance setting, such as scanning by the user sensor. Similarly, certain indicators may be activated to display the current operating settings to the service person.

In the context of this disclosure, the term "operational parameter" refers to a parameter, which can be set by a user or service person, such as the length of the material sheet which are to be fed out of the dispenser. Another example of an operational parameter is the operating mode of the dispenser, where operation may be controlled by the user sensor (sensor mode) or by activation when a user tears a sheet (hanging mode).

In the context of this disclosure, the term "dispenser function" refers to a functionality provided by the dispenser, such as dispensing of sheet material.

In the context of this disclosure, the term "sensing zone" refers to the area in front of a non-contact sensor in which the sensor can detect the presence of a user. The size, form and shape of the sensing zone depend on various factors and the sensing technology used. For example, for capacitive sensors the distance between the capacitive pad and the ground plane associated with the sensor is a factor, the covering material, as well as the size of the capacitive sensor pad all influence the sensing zone.

In the context of this disclosure, the term "graphical symbol or text" refers to symbols or text configured for providing visual guidance to the user and service person related to operation of various functions of the dispenser. The symbol typically indicates a function or manner of working through a pictorial resemblance to a certain physical object, and the text may typically describe the functionality, such as "On", "Off", "Sheet length", or the like.

In the context of this disclosure, the term "behind" and "overlap" is seen from a front of the interface. The graphical symbol or text may partially or completely overlap with the underlying additional sensor or indicator. Overlapping means that the main printed circuit board is located behind the protective cover and arranged relative the at least one graphical symbol or text such that the at least one additional sensor is configured to detect a user touching the at least one graphical symbol or text.

According to an embodiment, the user sensor is located on the main printed circuit board. This arrangement further enhances the integration of sensors on a single printed circuit board, thereby further reducing manufacturing cost of the interface and dispenser.

According to an embodiment, the interface further includes at least one of the following indicators: an indicator for indicating the type of operating mode of the dispenser, an indicator for indicating current setting of a sheet length, an indicator for indicating level of supply sheet material, and an indicator for indicating level of battery voltage. The type of operating mode of the dispenser may for example be sensor mode or hanging mode. The operating mode indicator may be one or more discrete indicators, such as light emitting diodes, and can be arranged overlapping with suitable graphical symbol or text on the protective cover. The indicator for the current setting of the sheet length may include a plurality of indicators, each representing, alone or in combination, an individual sheet length. The indicator for indicating level of supply sheet material and the indicator for indicating level of battery voltage may each be a single indicator that is activated when the indicated level falls below a predetermined threshold level, or a plurality of indicators each representing a certain level. As an alternative to the discrete indicators described above, the indicators for each of the above mentioned parameters may be indicated by means of an electronic visual display, either combined on a single display or by means of a plurality of displays.

According to an embodiment, the user sensor is arranged to scan for the presence of a user in the proximity of the user sensor. This operating mode is referred to as sensor mode. The user sensor is a non-contact sensor, i.e. a sensor that does not require physical contact but instead detects the presence of a user in the proximity of the sensor. The detection range is set according to the need of the specific situation, for example up to about 30 cm or less, for enabling easy handling but avoiding undesirable activation. Non-contact sensors have no mechanical parts moving upon activation by a user, thereby providing improved reliability. The non-contact sensors also can be protected by a protective cover without holes or openings to avoid moisture and dust from entering the sensor. The manufacturing of the housing is thereby also reduced due to lack openings and sealing for control buttons.

According to an embodiment, the user sensor and the at least one additional sensor are capacitive proximity sensors. By using capacitive sensors on the main printed circuit board the interface does not utilize any moving parts for either detecting the presence of a user or for changing any setting or for changing any operating mode of the dispenser. In other words, a more robust interface is provided in which there are no moving parts which can be worn out by prolonged use or by misuse. This also simplifies the manufacturing of the interface and thereby the dispenser. Alternatively, one or more of the non-contact sensors may be infrared sensors or optical sensors.

According to an embodiment, a metal pad formed on the surface of the main printed circuit board forms one electrode of the at least one additional capacitive sensor.

According to an embodiment, an antenna of the capacitive user sensor is offset from the main circuit board. The antenna is here electrically connected and forms part of the sensing pad of the capacitive sensor. This design enables increased sensitivity.

According to an embodiment, the antenna of the user sensor is offset from the main printed circuit board with a distance in the range of 5-100 millimeters, specifically 10-50 millimeters, and more specifically 10-20 millimeters, in a direction perpendicular to a plane of the main printed circuit board.

According to an embodiment, the antenna of the user sensor is arranged on a printed circuit board. Forming the antenna on a printed circuit board enables cost-effective manufacturing of the antenna and low variation in terms of performance. The antenna printed circuit board may subsequently be mounted to the dispenser or interface.

According to an embodiment, the antenna of the user sensor and the sensing electrode of the main printed circuit board are electrically connected by means of an electrically conductive compression spring device. Thereby no cable connections are needed to connect the antenna with the sensing electrode of the capacitive sensor. No cable connections enable easier manufacturing and assembly of the dispenser.

According to an embodiment, the antenna of the user sensor during operation is superimposed over the main printed circuit board. The arrangement enables a sufficient sensory range/distance with a more compact design and simplified electrical connection between the antenna and sensor.

According to an embodiment, the dispenser operational parameter is a sheet length and/or operating mode setting.

According to an embodiment, the at least one additional sensor is arranged to adjust the setting of sheet length from a first setting to a second setting upon actuating the at least one additional sensor shorter than a predetermined period of time. By evaluating the actuating time of the sensor a single sensor may be used for adjusting more than one operational parameter of the interface. Consequently, when the actuation time is shorter than a predetermined threshold value a first operational parameter is adjusted, such as the sheet length, and when the actuation time is longer than the predetermined threshold value a second operational parameter is adjusted, such as the operating mode. Thereby the number of sensors can be reduced. The predetermined period of time may typically be between 1 and 7 seconds, or between 2-6 seconds.

According to an embodiment, the interface can be set to two operating modes within the user setting, namely a first operating mode which corresponds to a sensor mode in which sheet feed operation is temporarily activated upon detection of a user by means of the user sensor, and a second operating mode which corresponds to a hanging mode in which sheet feed operation is activated upon removal of a previously dispensed sheet. The sensor mode provides the highest degree of hygiene because the sheet material is stored inaccessible to the users within the dispenser until a user is detected by the user sensor. This mode however consumes relatively much electrical power due to the continuous scanning of the user sensor. The hanging mode consumes much less energy due because the lack of scanning of the user sensor. In this mode however, a sheet length is pre-feeded and protrudes out of the dispenser, thereby reducing the level of hygiene. Removal of a previously dispensed sheet may be detected by activation of a tear bar sensor.

According to an embodiment, the interface includes a detector for initiating switching from the user setting to the maintenance setting of said interface, and back. The detector may for example be arranged to automatically detect opening and closing of a hood of the dispenser, thereby simplifying handling during refill and adjustment of operational parameters. The detector can be located on the main printed circuit board to reduce the amount of electrical cables needed. In one particular solution, the detector is a Hall sensor located in the printed circuit board, which sensor is arranged to interact with a magnet located in the dispenser hood.

According to an embodiment, the maintenance setting corresponds to the user sensor being set in non-operational state. Normally, there is no need for the user sensor during refill and service. On the contrary, an intentional feeding only disturbs this work.

In the maintenance setting the at least one additional sensor for adjusting at least one dispenser operational parameter or for activating at least one dispenser function is set in operational state. This has the advantage of enabling adjustment of operational parameters and activation of dispenser functions during maintenance, but preventing these actions in the user setting. Thereby unintentional or unauthorised reconfiguration is prevented. Moreover, the at least one indicator is set in operational state only during the maintenance setting. This has the advantage of avoiding unnecessary energy consumption and unaesthetically indicating during user setting.

According to an embodiment, in the user setting the at least one additional sensor for adjusting at least one dispenser operational parameter or for activating at least one dispenser function is set in non-operational state. This has the advantage of preventing unintentional or unauthorised adjustment in the user setting. Also, the at least one indicator is set in non-operational state during user setting for avoiding unnecessary energy consumption and unaesthetically indicating during user setting.

According to an embodiment, the main printed circuit board includes a position sensor which is arranged to interact with a supply level detection arm of the dispenser for determining the current sheet material supply level. The supply level detection arm includes for example a magnet and the position sensor is for example a Hall sensor, wherein the supply level detection arm is arranged to be able to change the distance to said position sensor depending on the level of the sheet material supply, and wherein the interface is arranged to indicate a low supply level of sheet material when the output signal from the position sensor reaches a predetermined value. The supply level detection arm is arranged to rest on the periphery of the sheet supply roll, or the top of the sheet supply stack, such that the arm follows the outer 'level' of the remaining sheet supply and moves as the remaining supply diminishes. The arm is pivoted around an axle such that the magnet of the arm can interact with the Hall sensor for triggering low supply level.

According to an embodiment, the protective cover is an integrally formed panel of a feeding cassette of the dispenser. This design enables a smooth appearance of the interface and makes use of the existing panel of the cassette. Alternatively, the protective cover includes a separate panel that is fastened to the feeding cassette or main printed circuit board.

According to an embodiment, the supply of sheet material is a continuous roll of paper, a continuous folded paper stack, a roll of paper sheets or a stack of folded paper sheets.

According to an embodiment, the at least one additional sensor is a direct feed sensor configured for direct operation of a dispensing motor and feed roller. A direct feed sensor may be useful during refill for the purpose of feeding the leading trail of the sheet material through the feeding mechanism, or for testing the functionality of the motor and feed rollers.

According to an embodiment, the indicator for indicating level of battery voltage is arranged to indicate when battery voltage is lower than a predetermined level.

According to an embodiment, the indicator for indicating level of supply sheet material is arranged to indicate when supply level is lower than a predetermined level.

According to an embodiment, the graphical symbol or text is arranged to provide visual guidance related to adjustment of at least one dispenser operational parameter, activation of at least one dispenser function, setting or status of an operating mode of said dispenser. The graphical symbol or text may be arranged overlappingly with one or more indicators for improved visual guidance.

According to an embodiment, the at least one indicator is constituted by a light source, for example a light emitting diode or similar.

According to an embodiment, the interface includes a plurality of indicators, all of which are located on the main printed circuit board. Similarly, all capacitive sensors of the interface may be located on the main printed circuit board. This enables a cost-effective solution and simplified assembly.

According to an embodiment, an automatic hygienic sheet material dispenser includes an interface as described herein.

The dispenser includes a chassis arranged to be fastened to a support structure, and a hood pivotally connected to the chassis for enabling servicing of the dispenser, wherein the hood in its closed position covers the at least one indicator, the at least one additional sensor, and the at least one graphical symbol or text. This arrangement provides a cleaner appearance of the dispenser and avoids unauthorised adjustment of the operational parameters.

The dispenser includes a feeding cassette installed in the chassis, wherein the main printed circuit board is mounted on a front surface of the feeding cassette with the at least one additional sensor and the at least one indicator facing forwards. This provides easy access to the interface during servicing.

According to an embodiment, a method for adjusting at least one dispenser operational parameter or for activating at least one dispenser function of an automatic hygienic sheet material dispenser by means of the interface is provided. The interface including a user sensor arranged to have a sensing zone and to detect the presence of a user within the sensing zone. The interface further including, located on a main printed circuit board, at least one additional sensor, at least one indicator for indicating the setting or status of an operational parameter of the dispenser, and a main microcontroller. The method including the steps of: switching operation of the dispenser from a user setting to a maintenance setting; and adjusting at least one dispenser operational parameter or activating at least one dispenser function by touching at least one graphical symbol or text located on a protective cover located in front of the main printed circuit board, such that the at least one additional sensor becomes actuated.

BRIEF DESCRIPTION OF THE DRAWINGS

Embodiments of the invention will now be described with reference to the appended drawings, in which.

DETAILED DESCRIPTION OF PARTICULAR EMBODIMENTS

Figure 1:
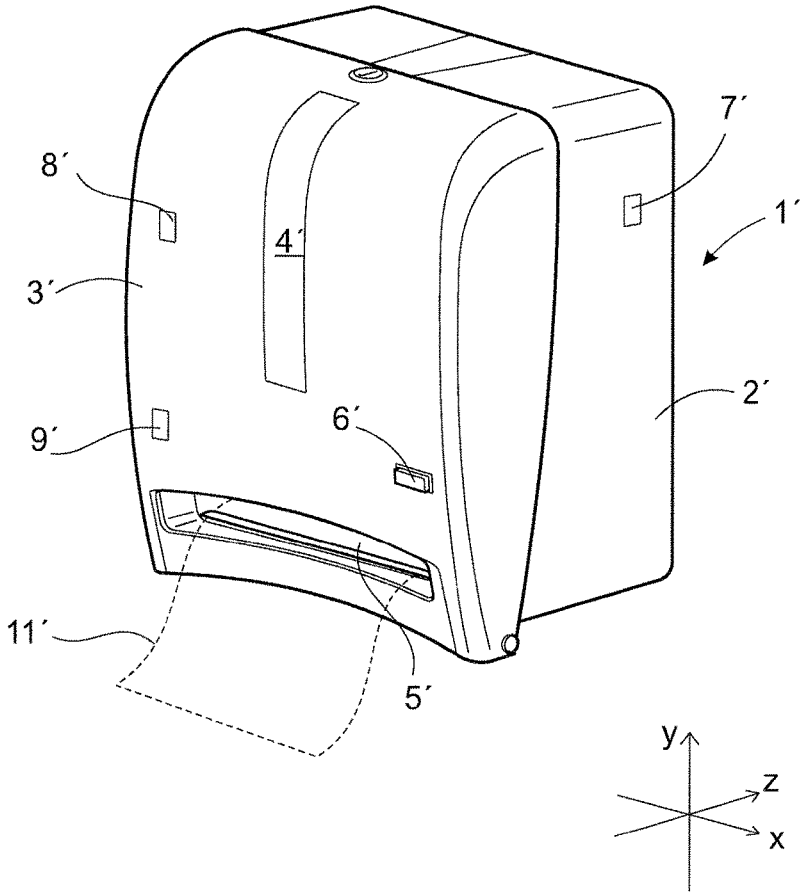
FIG. 1 shows a dispenser for sheet material according to prior art.

FIG. 1 shows a perspective view of a sheet material dispenser according to prior art. The dispenser 1' includes a housing 2' with a hood 3' extending generally in a vertical plane defined by axes X and Y as shown in FIG. 1. The hood 3' covers the front of the housing 2' and is designed with a transparent slit 4', suitably of plastic material, by means of which it can be investigated whether the supply of sheet material needs refilling. Furthermore, the dispenser is provided with a discharge opening 5' which is arranged for guiding of sheet material upon detection of the presence of a user. Said detection is carried out by means of a proximity sensor 6'.

The dispenser shown in FIG. 1 can also be provided with a switch 7' or a similar device for setting a particular operational parameter, such as a setting of the length of sheet material which is to be fed out. The dispenser 1' can furthermore be provided with an indicator 8' for indicating a setting of an operational parameter (such as the sheet length). A further indicator 9' can also be provided for indicating a parameter such as a low level of battery voltage. Although not shown in FIG. 1, the dispenser is equipped with a motor arranged for feeding the sheet material so as to be discharged out of the dispenser 1'. A length of a sheet material 11' is shown by means of dashed lines in FIG. 1, so as to illustrate the operation of the dispenser.

Figure 2:
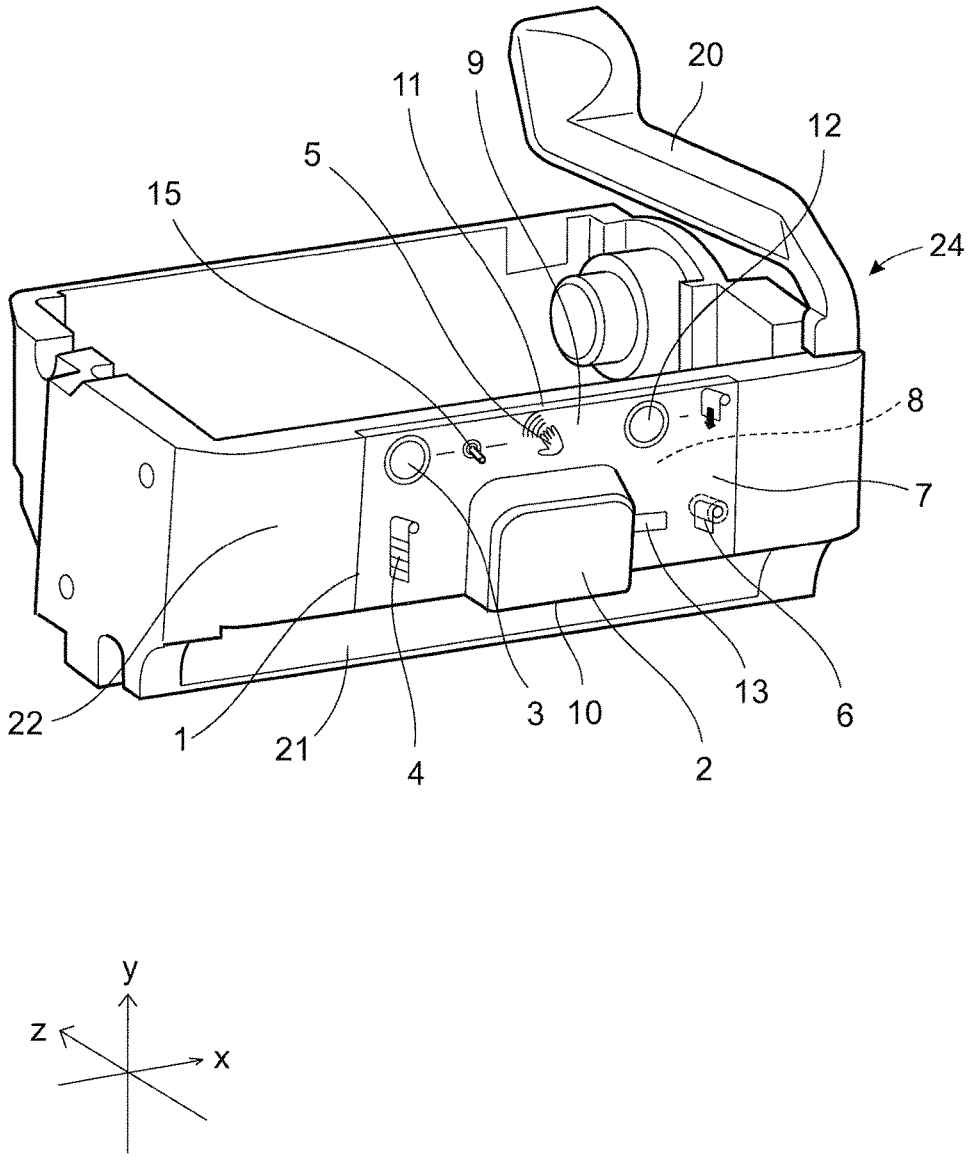
FIG. 2 schematically shows an interface of an automatic sheet material dispenser as mounted into a part of a feeding cassette or a dispenser housing.

Embodiments of the invention integrate certain core components of a dispenser in the form of a single more compact interface. FIGS. 2-5 illustrate a particular embodiment. FIG. 2 schematically shows a feeding cassette 24 of a dispenser. An interface 1, i.e. a dedicated communication and control unit of an automatic hygienic paper dispenser is provided on a front panel 22 of the feeding cassette 24. As opposed to FIG. 1, an entire dispenser is not shown in FIG. 2, but merely the feeding cassette 24, which is arranged to be mounted within the housing of a dispenser. The feeding cassette 24 of FIG. 2 is adapted to feed sheet material from a roll of continuous sheet (not shown), which is arranged to be located above the feeding cassette 24 in a Y-direction. The dispenser is suitably arranged for being hung upon a wall and is configured for feeding out sheets of material through a dispensing opening 21 by means of a (not shown) motor. A supply level detection arm 20 is attached to the feeding cassette 24. The interface 1 is equally applicable for being provided on a dispenser arranged for accommodating and feeding sheet from a stack of sheet material, such as paper, from its interior. The interface includes a protective cover 7 mounted directly in front of a main printed circuit board, such that the protective cover 7 and main printed circuit board are arranged substantially parallel and overlapping. Graphical symbols and/or text 3, 4, 5, 6, 12, 13, 15 are provided on the protective cover and arranged overlapping with non-contact sensors and indicators provided on the underlying circuit board, such that an interface 1 with essentially virtual buttons 3, 12 is provided. The protective cover 7 is at least partly transparent or semi-transparent for enabling the indicators of the main printed circuit board to be visible by a user or service person located in front of the interface 1, as will be described more in detail below. Power supply in form of batteries and external connection is also located in the feeding cassette 24, as well as the motor, thereby gathering all electrical components of the dispenser to a limited region of the dispenser, which region in the disclosed embodiment corresponds to the feeding cassette 24. This collection of electrical components to a small region simplifies assembly and manufacturing of the dispenser. Moreover, by locating all or at least a significant portion of the sensors, buttons and indicators on the main printed circuit board many electrical cables can be eliminated and the interface 1 can arrive at dispenser assembly station as a finished unit that only requires mounting within the dispenser chassis, thereby even further simplifying assembly and manufacturing of the dispenser.

Figure 3:
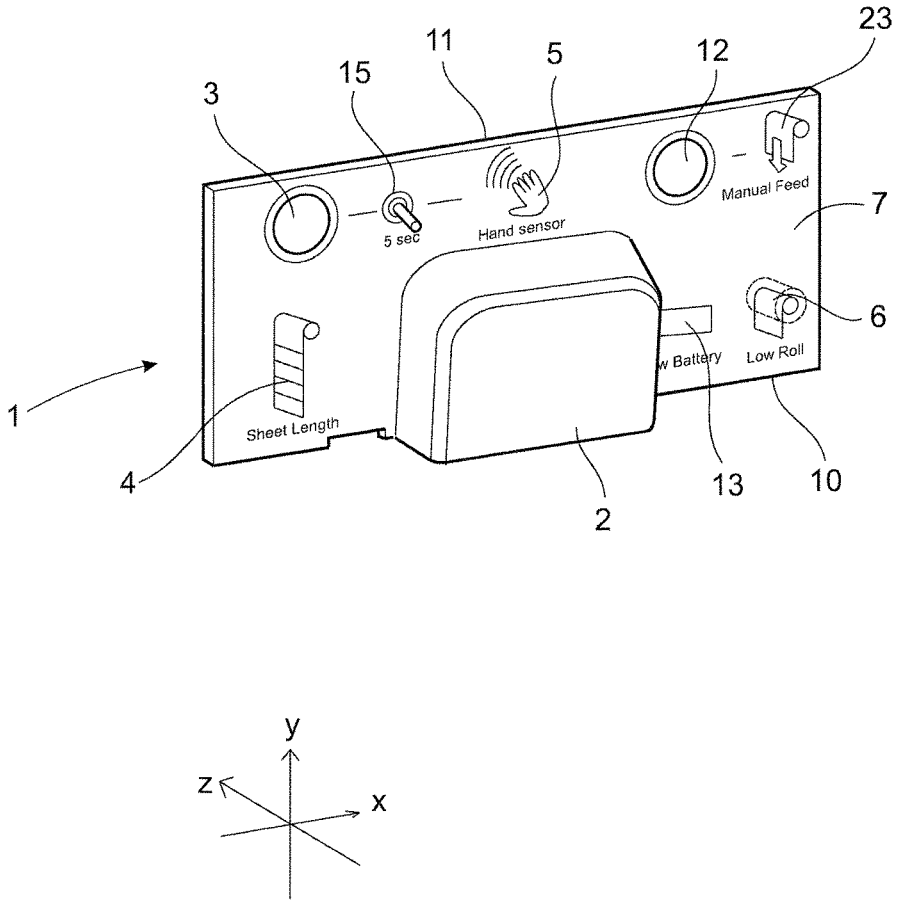
FIG. 3 schematically shows an interface being separated from a dispenser housing.
Figure 4:
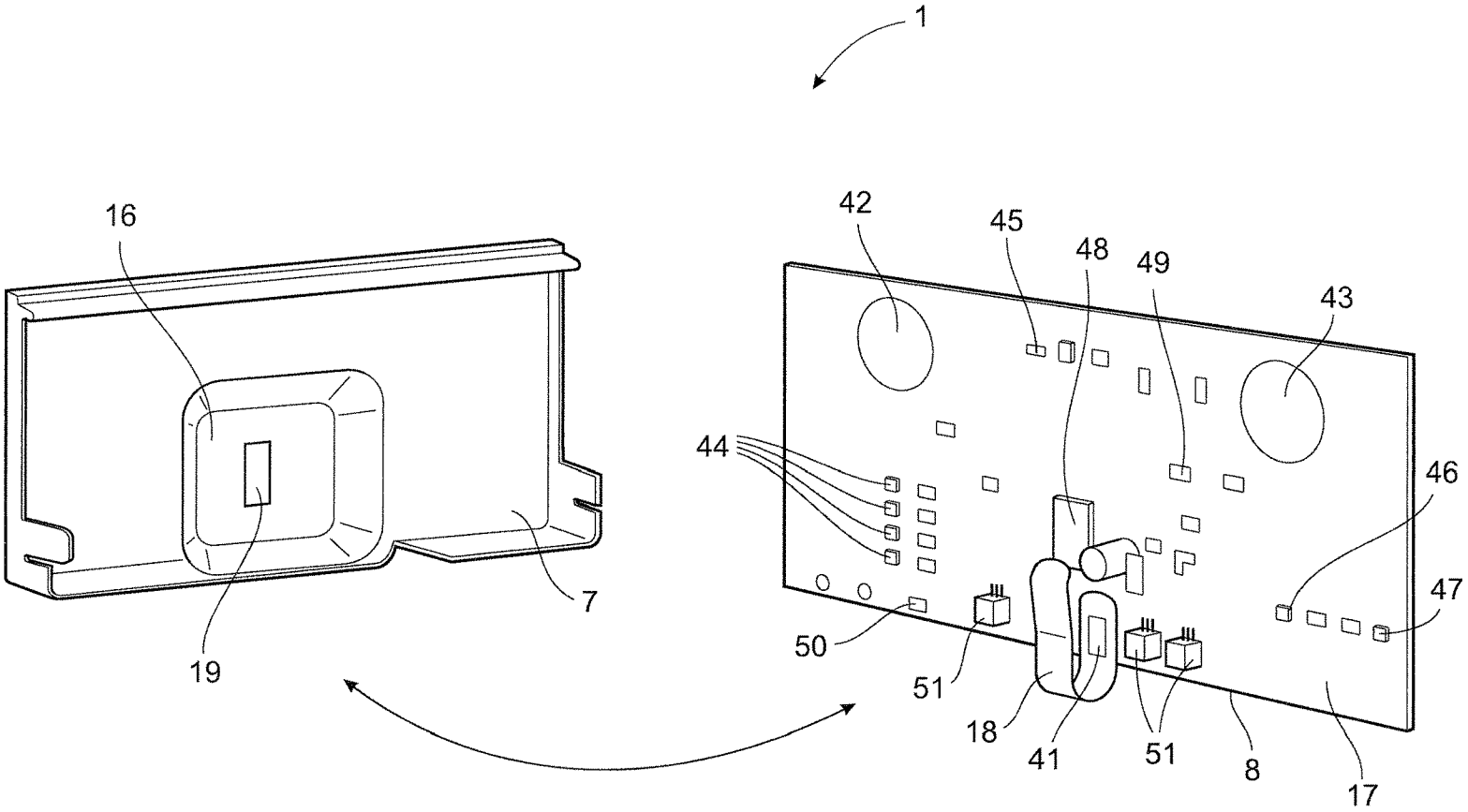
FIG. 4 schematically shows an exploded view of an interface having a main printed circuit board and an antenna board.

FIG. 3 shows the protective cover 7 of FIG. 2 more in detail, and FIG. 4 schematically shows an exploded view of the interface 1. The interface 1 includes a user sensor 2 arranged to have a sensing zone and to detect the presence of a user within the sensing zone. The user sensor 2 is located essentially in the centre 9 of the interface 1, as seen in a lengthwise direction X, and along a bottom edge 10 of the interface 1, as seen in a Y-direction. Located on a left hand side of the interface 1 is a first additional sensor 3, herein also referred to as operational parameter control sensor 3, and a first indicator 4. The operational parameter control sensor 3 is a non-contact sensor that is located behind the protective cover 7 and arranged to detect when a user's finger or the like is located within a sensing zone of the operational parameter control sensor 3. Located along a top edge 11 of the interface 1 are a second indicator 5 and a second additional sensor 12, herein also referred to as direct feed sensor 12. Also the direct feed sensor 12 is a non-contact sensor that is located behind the protective cover 7 and arranged to detect when a user's finger or the like is located within a sensing zone of the direct feed sensor 12. Located on the right hand side of the interface 1 is a third indicator 6, also referred to as low supply indicator 6, and a fourth indicator 13, also referred to as low battery indicator 13. The indicators 4, 5, 6, 13 can be constituted by light sources, for example in the form of light emitting diodes (LED's).

The user sensor 2 and the first and second additional sensors 3, 12, can be constituted by individual capacitive sensors. According to known sensor technology, such capacitive sensors can be used for indicating the presence of a human, for example a hand of a person which is located in front of the respective sensor 2, 3, 12. In this manner, the user sensor 2 enables the dispenser to be operated a "sensor mode", i.e. an operating mode in which a certain amount of sheet material is dispensed out from the dispenser as a result of a presence of a user being detected in the sensing zone of the user sensor 2. The capacitive sensor technology also allows the first and second additional sensors 3, 12 to be actuated in a non-contact manner, i.e. without physical contact to actual physical sensor 3, 12. The user may instead touch graphical symbols or text that is provided in a protective cover positioned in front of main printed circuit board 8 carrying the sensors 3, 12, thereby effectively providing virtual buttons 3, 12.

The interface 1 cooperates with a motor (not shown) arranged for feeding said sheet material out of the dispenser. After feeding, a user may grab the sheet material and remove it from the dispenser by tearing it from the sheet material supply by means of a tear bar (not shown) located adjacent a sheet material dispensing opening 21 of the feeding cassette 24. Normally, the tear bar is slightly pivotable and can thereby interact with a tear bar sensor, such as a mechanical switch. The activation of the tear bar switch is generating a signal that confirms that a previously dispensed sheet has been removed. The sensors 2, 3, 12 and indicators 4, 5, 6, 13 are all connected to a microcontroller 48, which is configured to control various operating modes of the interface 1.

The dispenser operates either in a user setting or a maintenance setting. When the dispenser is in the user setting it may be operated in various operating modes. The interface enables a user or service person to select a desired operating mode. A first operating mode is herein also referred to as sensor mode and a second operating mode is herein also referred to as hanging mode.

When the dispenser 1 is set to operate in the sensor mode, the user sensor 2 is used for detecting the presence of a user and the microcontroller 48 is programmed to react to a signal from said user sensor 2 by activating the motor for a time which is long enough to feed a sheet of a predetermined length.

As will be explained below, the desired length of the sheet material can be set by actuating the operational parameter control sensor 3. Also, a characteristic of the sensor mode is that the operational parameter control sensor 3 and the direct feed sensor 12 are not active (non-operational) for avoiding unintentional and/or unauthorised adjustment/control of dispenser settings.

When the dispenser 1 is set to operate in the hanging mode, the dispenser immediately feeds out a length of sheet material, which is intended to hang out from the dispensing opening 21. When a user arrives at the dispenser a sheet is already hanging out and is available for use. The user may thus grab this sheet and tear it against the tear bar. The tearing action will exert a force on the tear bar that may be detected using a tearing sensor. For example, the tear bar may be located in a first position, which corresponds to a natural state, when no force is acting on the tear bar, and a second position when a user is pulling the sheet against the tear bar for tearing of the sheet. A tear sensor, such as a mechanical switch, may then be provided to detect when the tear bar occupies the second position. When the microcontroller 48 receives information from the tear sensor that the tear bar is displaced it is programmed to react by feeding a new sheet after a small time period, which new sheet is intended to hang out for being grabbed by the next user. This operating mode is characterised by low power consumption because no scanning is performed by the user sensor 2, and some parts of the dispenser can enter a sleep mode in the time period between consecutive feeding sequences.

Furthermore, the dispenser may be operated in a maintenance setting. The maintenance setting is intended primarily for a service person in order to control and adjust certain settings of the interface 1. According to an embodiment, the dispenser is automatically set in the maintenance setting upon opening of a dispenser hood (not shown), which forms part of the dispenser. In the maintenance setting the user sensor 2 is inactivated for avoiding undesired feeding of the dispenser merely because the service person stands close to the dispenser. Also, the operational parameter control sensor 3 and the direct feed sensor 12 are both active (operational) in the maintenance setting for enabling the service person to adjust the operational parameters of the dispenser, as well as for feeding a leading trail of a refill sheet roll through the feeding mechanism of the feeding cassette 24. One operational parameter of the dispenser that may be adjusted by the service person is for example the length of the sheet material to be fed out of the dispenser. In order to automatically enter the maintenance setting, the interface 1 may include a suitable detector 50, such as a Hall sensor for detecting when the hood is in an opened state. As soon as the hood is closed, this may be detected by said detector 50, thereby automatically leaving the maintenance setting and entering the user setting either in the sensor mode or the hanging mode. Alternatively, the dispenser may be set in maintenance setting by a manual action, such as by means of a key, button, code, or the like.

As indicated above, the operational parameter control sensor 3 is arranged for setting a first operational parameter of the dispenser. According to an embodiment, this first operational parameter is constituted by the length of each sheet of material being fed out from the dispenser. The operational parameter control sensor 3 is suitably constituted by a capacitive sensor which is used for setting of said sheet length. According to an embodiment, this is carried out by actuating the operational parameter control sensor 3 for a time period shorter than a predetermined time period. Such actuation of the operational parameter control sensor 3 results in adjustment of the setting of sheet length from a first setting to a second setting. In particular embodiments, a further third and fourth feed length setting by selected by actuating the operational parameter control sensor 3 multiple times. After a certain number of actuations, for example four consecutive actuations, feed length setting returns to its initial condition corresponding to the first setting. The interface 1 can be arranged to provide more than two different sheet lengths, each of which can be selected by actuating the operational parameter control sensor 3 in a stepwise fashion. The first indicator 4 may include four light sources, such as LEDs, arranged to indicate the currently selected sheet length setting.

The second sensor 3 can according to a particular embodiment have dual functionality in terms of also setting the dispenser either in the sensor mode or the hanging mode. This is realised by actuating the operational parameter control sensor 3 for a time which is longer than the predetermined period of time, for example 5 seconds. This will cause the operating mode to switch between the sensor mode and the hanging mode, and vice versa.

The first indicator 4 is a sheet length indicator arranged to indicate the setting of the first operational parameter, i.e. the dispensed sheet length. The second indicator 5 is arranged to indicate whether the dispenser is operating in the sensor mode or the hanging mode. For example, normal operation in which the user sensor 2 is active can be indicated by means of a green light from the second indicator 5. Furthermore, the third indicator 6 is arranged to indicate a low supply of sheet material. For example, a condition in which there is a relatively low amount of sheet material left in the dispenser can be indicated by means of a yellow light. In addition, the fourth indicator 13 is arranged to indicate a low battery charge level of the dispenser battery, for example by activating the indicator when the battery charge level falls below a predetermined level.

The interface 1 includes a main printed circuit board 8 and a protective cover 7. The operational parameter control sensor 3, the direct feed sensor 12, the user sensor 2, all indicators 4, 5, 6, 13 and the microcontroller 48 are all located on the main printed circuit board 8, such that a high degree of integration is realised. The operational parameter control sensor 3 and the direct feed sensor 12 are capacitive sensors, each having a sensor pad located on a front side 17 of the main printed circuit board 8. The user sensor 2 is also a capacitive sensor, but additionally connected to an external antenna, which is offset from the main oriented circuit board 8 in a direction perpendicular to the plane of the circuit board, i.e. direction Z. The protective cover 7 is provided in front of the main printed circuit board. The protective cover 7 can be made of plastic material, such as ABS, and and includes graphical symbols and/or text 3, 4, 5, 6, 12, 13, 15. The main printed circuit board 8 is arranged relative the graphical symbol and/or text 3, 4, 5, 6, 12, 13, 15 such that the at least some of the graphical symbol and/or text overlaps with the sensors 3, 12 and/or indicators 4, 5, 6, 13 located on the main printed circuit board 8. Thereby virtual touch buttons are provided which may be actuated when the user touches the graphical symbols or text on the protective cover. The sensing zone of the operational parameter control sensor 3 and the direct feed sensor 12 may be selected such that a user does not even have to touch the protective cover to activate the sensor. The protective cover 7 may according to an alternative embodiment (not shown) be an integral part of the front panel 22 of the feeding cassette 24, thereby completely eliminating any openings in the front panel and improving the aesthetical appearance. The design solution having non-contact sensors and indicators located behind an at least partly transparent protective cover provides a cost-effective, highly integrated, compact and reliable solution.

When the interface 1 is in the sensor mode, the microcontroller can save energy by entering a "waiting state", where most of the functions of the microcontroller are shut down. This waiting state is being entered when there has been no sheet taken for a predetermined period of time, for example 30 minutes. Upon entering this waiting state, the microcontroller first feeds a sheet to be hanging at the dispensing outlet, and then shuts down said functions. Next, when a user arrives, grabs this sheet and tears it, a tearing sensor (not shown in the drawings) will "wake" the microcontroller 48, which then leaves the waiting state and operates in an active operating mode again, i.e. either the sensor mode or the hanging mode.

As mentioned above, the length of the sheet to be fed out is set by actuating the operational parameter control sensor 3 for a period of time shorter than a predetermined period of time. Actuating the operational parameter control sensor 3 several times increases the predetermined length of the sheet until a maximum sheet length is reached. Actuating the operational parameter control sensor 3 when the predetermined length of the sheet is at its maximum length resets the predetermined length to the minimum length.

The direct feed sensor 12 controls operation of the feeding mechanism, such that the motor is operated as soon as the direct feed sensor 12 is actuated. The operation of the motor continues until the direct feed sensor 12 stops being actuated.

Figure 5B:
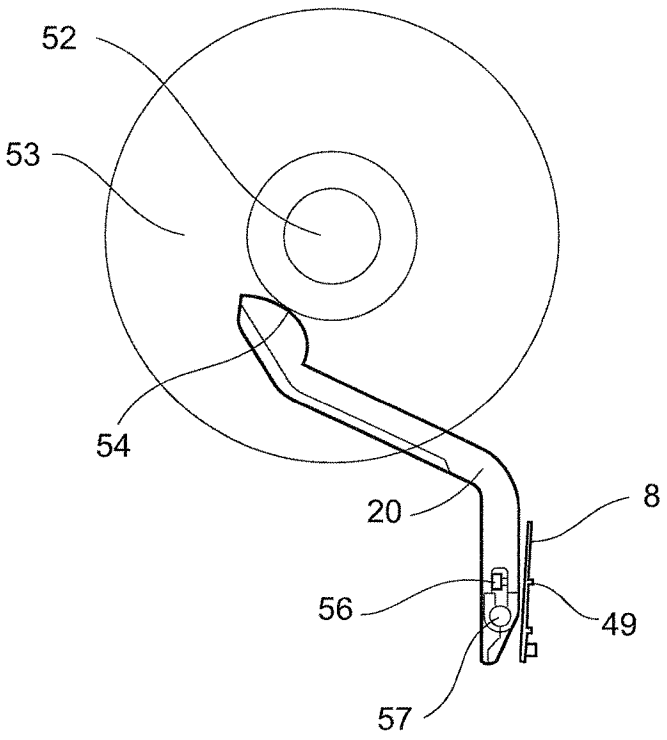
FIG. 5*a*, 5*b* schematically show a supply level detection arm.
Figure 5A:
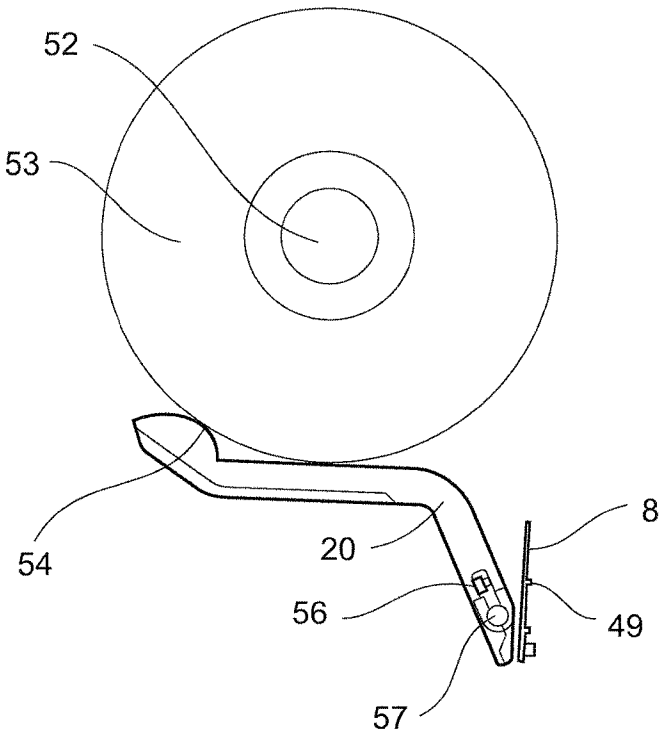

The low supply indicator 6 is arranged to indicate the level of sheet material supply still available within the dispenser. The actual supply level may be measured in many different ways and the microcontroller receives information reflecting the current supply level and controls the low supply indicator accordingly. A supply level detection arm 20 is a particular means for detecting the present supply level due to its robustness, reliability and low energy consumption. FIGS. 5*a* and 5*b* show more in detail an embodiment of the supply level detection arm for a dispenser that is arranged to dispense sheet material from a roll 53 of sheet material. In a certain embodiment, the supply level detection arm 20 is in sliding contact 54 with an outer cylindrical surface of the roll 53. Thereby the supply level detection arm 20 will have an angular position reflecting the present sheet material supply level. The arm 20 is pivotally connected to the feeding cassette 24 along a pivot axis 57, and, in particular embodiments, spring loaded to exert a certain contact force against the roll 53. The supply level detection arm 20 may even have dual functionality in terms of also functioning as a roll brake for the sheet material roll 53. According to a solution, the supply level detection arm 20 is provided with a magnet 56 located adjacent a Hall sensor 49 of the main printed circuit board 8, wherein the position of the magnet 56 is a function of the present angular position of the supply level detection arm 20. Thereby, the angular position of the supply level detection arm 20 can be monitored by means of the output signal from the Hall sensor 49. If sheet material from a stack of sheet material is dispensed then the supply level detection may abut the side of the sheet supply stack that displaces upon sheet material dispensing, such that the position of the arm is a function of the remaining supply level. The microcontroller 48 is programmed to activate the low supply indicator 6 when the Hall sensor output signal reaches a predetermined threshold.

FIG. 4 schematically shows an exploded view of an interface 1. The main printed circuit board 8 is shown in perspective view from a front side and the protective cover is shown in perspective view from the rear side. In the embodiment, the main printed circuit board 8 is mounted in a recess in a front panel of the feeding cassette 24 and the protective cover 7 is fastened over the main printed circuit board 8 to protect the circuit board 8 from moisture and dust. The capacitive user sensor 2 includes a capacitive sensor located on the main printed circuit board 8, an antenna 16 and an electrical communication device for electrically connecting the capacitive sensor with the antenna 16. The capacitive sensor includes a sensing pad 41 that is electrically connected to the antenna 16, which may be located on a printed circuit board and connected to the sensing pad 41 via a spring device 18. The printed circuit board carrying the antenna 16, hereinafter also referred to as antenna printed circuit board, includes an electrically conductive member functioning as an external sensing pad (not shown) on the front side and an electrical connection pad 19 on the rear side for contacting the spring device 18 when the interface 1 is assembled. The external antenna printed circuit board enables enlarged sensing zone of the user sensor 2. In some cases it might even be preferred to locate the entire user sensor 2, i.e. the capacitive sensor pad and any potential antenna, directly on the antenna printed circuit board in order to more exactly meet a desired sensing range.

Also provided on the front side 17 of the main printed circuit board 8 are a sensing pad 42 of the capacitive operational parameter control sensor 3, a sensing pad 43 of the capacitive direct feed sensor 12, four LED indicators 44 associated with the first indicator 4 for indicating the currently selected sheet length, a LED indicator 45 associated with the second indicator for indicating the currently selected operating mode, a LED indicator 47 associated with the third indicator for indicating low supply level, and a LED indicator 46 associated with the fourth indicator for indicating low battery level. Also provided in the main printed circuit board is the microcontroller 48, a Hall sensor 49 or the like for monitoring the sheet material supply level in combination with the supply level detection arm 20, a further Hall sensor 50 or the like for determining when the hood in in the closed position. The main printed circuit board further includes a plurality of coupling ports 51 for connection to external components, such as batteries/power supply, tear bar sensor input and feed motor output signal.

An optional part of the interface 1—which is not disclosed in the drawings—is a communication module, which can be arranged on the main printed circuit board 8. Such a communication module can be connected to one or more of the sensors forming part of the interface 1, so that data registered by said sensor can be transmitted to a remote data collection unit (DCU). For example, the communication module can be configured for wireless communication with said remote DCU. Furthermore, the DCU be connected, for example via a wireless telephone network, to a remote server in order to log the sensor input information from the interface 1. In this manner, information can be collected remotely to indicate for example when a certain number of actuations of the dispenser has been made, which can correspond to a need to fill the supply of sheet material in the dispenser.

According to an aspect, a method for adjusting at least one dispenser operational parameter or for activating at least one dispenser function of an automatic hygienic sheet material dispenser by means of an interface 1. The interface 1 including a main printed circuit board 8 having a user sensor 2 arranged to have a sensing zone and to detect the presence of a user within the sensing zone, at least one additional sensor 3, 12, at least one indicator for indicating the setting or status of an operational parameter of the dispenser, and a main microcontroller. The method include the steps of switching operation of the dispenser from a user setting to a maintenance setting, and adjusting at least one dispenser operational parameter or activating at least one dispenser function by touching at least one graphical symbol or text located on a protective cover 7 located in front of the main printed circuit board 8, such that the at least one additional sensor 3, 12 becomes actuated.

Reference signs mentioned in the claims should not be seen as limiting the extent of the matter protected by the claims, and their sole function is to make claims easier to understand.

The drawings and the description are to be regarded as illustrative in nature, and not restrictive.

For example, two separate sensors can be used instead of the second sensor 3 which is used both for selecting between the hanging mode or sensor mode, and also for setting the sheet length.

Furthermore, several additional operating modes can be used in addition to the ones mentioned above, For example, an operating mode called "short mode" can be used, in which a short piece of sheet material is discharged if another sheet is wanted less that some 30 seconds after feeding of a normal piece of sheet material. This is advantageous when a user first needs a long piece of sheet material to dry the hands, and then a short additional piece of sheet material to dry any residues of liquid on the hands.

The invention claimed is:

1. An interface for communicating with and for controlling the operation of an automatic hygienic sheet material dispenser, the interface comprising:

a user sensor arranged to have a sensing zone and to detect the presence of a user within the sensing zone;

at least one indicator for indicating the setting or status of an operational parameter of the dispenser;

a main microcontroller;

at least one additional sensor for adjusting at least one dispenser operational parameter or for activating at least one dispenser function, the at least one additional sensor configured to be actuated to adjust the at least one dispenser operational parameter or activate the at least one dispenser function without physical contact to the at least one additional sensor; and a protective cover comprising at least one graphical symbol or text, wherein the at least one additional sensor, the at least one indicator and the main microcontroller are located on a main printed circuit board, the main printed circuit board being located behind the protective cover and arranged relative to the at least one graphical symbol or text such that (i) the at least one graphical symbol or text overlaps with the at least one additional sensor or the at least one indicator, (ii) the at least one indicator is visible through the protective cover, and (iii) the at least one additional sensor is configured to detect a touch of the at least one graphical symbol or text on the protective cover, and wherein the main microcontroller is arranged to selectively operate the dispenser in any of at least a user setting and a maintenance setting.

2. The interface according to claim 1, wherein the user sensor is located on the main printed circuit board.

3. The interface according to claim 1, further comprising at least one of the following indicators:

an indicator for indicating the operating mode of the dispenser;

an indicator for indicating current setting of a sheet length;

an indicator for indicating level of supply sheet material; and an indicator for indicating level of battery voltage.

4. The interface according to claim 1, wherein the user sensor and the at least one additional sensor are capacitive proximity sensors or IR-sensors.

5. The interface according to claim 1, wherein an antenna of the user sensor is offset from the main printed circuit board.

6. The interface according to claim 5, wherein the antenna of the user sensor is offset from the main printed circuit board with a distance in the range of 5-100 millimeters in a direction perpendicular to a plane of the main printed circuit board.

7. The interface according to claim 5, wherein the antenna of the user sensor is arranged on a printed circuit board.

8. The interface according to claim 5, wherein the antenna of the user sensor and the main printed circuit board are electrically detachably connected.

9. The interface according to claim 1, wherein said dispenser operational parameter is sheet length and/or operating mode.

10. The interface according to claim 1, wherein the at least one additional sensor is arranged to adjust the setting of sheet length from a first setting to a second setting upon actuating the at least one additional sensor shorter than a predetermined period of time.

11. The interface according to claim 1, wherein the at least one additional sensor is arranged to change the operating mode from a first operating mode to a second operating mode upon actuating the at least one additional sensor longer than a predetermined period of time.

12. The interface according to claim 11, wherein the first operating mode corresponds to a sensor mode, in which sheet feed operation is temporarily activated upon detection of a user by the user sensor, and wherein the second operating mode corresponds to a hanging mode, in which sheet feed operation is activated upon removal of a previously dispensed sheet.

13. The interface according to claim 10, wherein the predetermined period of time is in the range of 1 and 7 seconds.

14. The interface according to claim 1, further comprising a detector for initiating switching from the user setting to the maintenance setting of said interface.

15. The interface according to claim 14, wherein the detector is arranged to automatically detect opening and closing of a hood of the dispenser.

16. The interface according to claim 14, wherein the detector is located on the main printed circuit board.

17. The interface according to claim 14, wherein the detector is a Hall sensor arranged to interact with a magnet located in the hood.

18. The interface according to claim 1, wherein said maintenance setting corresponds to:

said user sensor being set in non-operational state;

said at least one additional sensor for adjusting at least one dispenser operational parameter or for activating at least one dispenser function being set in operational state, and said at least one indicator being set in operational state.

19. The interface according to claim 1, wherein said user setting corresponds to:

said at least one additional sensor for adjusting at least one dispenser operational parameter or for activating at least one dispenser function being set in non-operational state, and said at least one indicator being set in non-operational state.

20. The interface according to claim 1, wherein the main printed circuit board comprises a position sensor which is arranged to interact with a supply level detection arm of the dispenser for determining the current sheet material supply level.

21. The interface according to claim 20, wherein the supply level detection arm comprises a magnet and the position sensor is a Hall sensor, wherein the supply level detection arm is arranged to be able to change the distance to said position sensor depending on the level of the sheet material supply, and wherein the interface is arranged to indicate a low supply level of sheet material when the output signal from the position sensor reaches a predetermined value.

22. The interface according to claim 1, wherein the protective cover is an integrally formed panel of a feeding cassette of the dispenser, or a separate panel that is fastened to the feeding cassette or main printed circuit board.

23. The interface according to claim 1, wherein the supply of sheet material is a continuous roll of paper, a continuous folded paper stack, a roll of paper sheets, or a stack of folded paper sheets.

24. The interface according to claim 1, wherein the at least one additional sensor is a direct feed sensor configured for direct operation of a dispensing motor and feed roller.

25. The interface according to claim 3, wherein the indicator for indicating level of battery voltage is arranged to indicate when the battery voltage is lower than a predetermined level.

26. The interface according to claim 1, wherein the graphical symbol or text is arranged to provide visual guidance related to adjustment of at least one dispenser operational parameter, activation of at least one dispenser function, or setting or status of an operational parameter of said dispenser.

27. The interface according to claim 1, wherein the at least one indicator is constituted by a light source.

28. The interface according to claim 1, wherein the interface comprises a plurality of indicators, all of which are located on the main printed circuit board.

29. The interface according to claim 1, wherein the user sensor and the at least one additional sensor are capacitive sensors located on the main printed circuit board.

30. An automatic hygienic sheet material dispenser comprising an interface according to claim 1.

31. The dispenser according to claim 30, further comprising a chassis arranged to be fastened to a support structure, and a hood pivotally connected to the chassis for enabling servicing of the dispenser, wherein the hood in its closed position covers the at least one indicator, the at least one additional sensor, and/or the at least one graphical symbol or text.

32. The dispenser according to claim 30, further comprising a feeding cassette installed in the chassis, and wherein the main printed circuit board is mounted on a front surface of the feeding cassette with the at least one additional sensor and the at least one indicator facing forwards.

33. A method for adjusting at least one dispenser operational parameter or for activating at least one dispenser function of an automatic hygienic sheet material dispenser by an interface, the interface comprising a user sensor arranged to have a sensing zone and to detect the presence of a user within the sensing zone, at least one additional sensor located on a main printed circuit board and configured to be actuated to adjust at least one dispenser operational parameter or activate at least one dispenser function without physical contact to the at least one additional sensor, at least one indicator for indicating the setting or status of an operational parameter of the dispenser located on the main printed circuit board, and a main microcontroller located on the main printed circuit board, the method comprising:

switching operation of the dispenser from a user setting to a maintenance setting; and adjusting at least one dispenser operational parameter or activating at least one dispenser function by touching at least one graphical symbol or text located on a protective cover located in front of the main printed circuit board, the at least one indicator being visible though the protective cover, and the at least one graphical symbol or text being located on the protective cover so as to overlap with the at least one additional sensor located on the main printed circuit board such that the at least one additional sensor becomes actuated upon the touching of the at least one graphical symbol or text.

* * * * *